US012403350B2

(12) United States Patent
Wang

(10) Patent No.: US 12,403,350 B2
(45) Date of Patent: Sep. 2, 2025

(54) DUMBBELL AND FITNESS EQUIPMENT

(71) Applicant: Danni Wang, Ningbo (CN)

(72) Inventor: Danni Wang, Ningbo (CN)

( * ) Notice: Subject to any disclaimer, the term of this patent is extended or adjusted under 35 U.S.C. 154(b) by 254 days.

(21) Appl. No.: 17/863,355

(22) Filed: Jul. 12, 2022

(65) Prior Publication Data

US 2023/0067188 A1 Mar. 2, 2023

Related U.S. Application Data

(63) Continuation-in-part of application No. 17/403,839, filed on Aug. 16, 2021, now Pat. No. 11,458,348.

(51) Int. Cl.
*A63B 21/072* (2006.01)

(52) U.S. Cl.
CPC ..... *A63B 21/0728* (2013.01)

(58) Field of Classification Search
CPC ..... A63B 21/0722; A63B 21/0726; A63B 21/0728; A63B 21/075; A63B 21/004; A63B 21/072; A63B 21/0724
See application file for complete search history.

(56) References Cited

U.S. PATENT DOCUMENTS 5,090,693 A * 2/1992 Liang ..... A63B 21/0726 482/108
5,464,379 A * 11/1995 Zarecky ..... A63B 21/0728 482/106
5,779,604 A * 7/1998 Towley, III ..... A63B 21/0728 482/107
7,153,244 B2 * 12/2006 Towley, III ..... A63B 21/0728 482/108
2004/0063554 A1 * 4/2004 Wince ..... A63B 21/0724 482/109
2005/0261075 A1 * 11/2005 Pullaro ..... A63B 69/00 473/457
2007/0249475 A1 * 10/2007 Cao ..... A63B 21/0728 482/106
2013/0231225 A1 * 9/2013 Shozda ..... A63B 21/075 482/108
2020/0121973 A1 * 4/2020 Jones ..... A63B 21/0728

* cited by examiner

*Primary Examiner* — Megan Anderson

(57) ABSTRACT

The present disclosure relates to a dumbbell, which includes a first grip rod and two counterweight assemblies, each of both ends of the first grip rod defines a first screw hole, each of the two counterweight assemblies comprises at least one first counterweight, the first counterweight comprises a first connection portion, the first connection portion is threadedly received in the first screw hole to connect the first grip rod with the first counterweight. The present disclosure further provides a fitness equipment applying the dumbbell.

18 Claims, 14 Drawing Sheets

DUMBBELL AND FITNESS EQUIPMENT

CROSS-REFERENCE TO RELATED APPLICATIONS

This application is a continuation-in-part of U.S. application Ser. No. 17/403,839, filed on Aug. 16, 2021, the contents of which are incorporated by reference herein.

FIELD

This disclosure relates to a technical field of fitness equipment, specifically to a dumbbell and a fitness equipment.

BACKGROUND

In order to keep healthy, people use different fitness equipment for exercise, and dumbbells are relatively common fitness equipment. A dumbbell includes a first grip rod and counterweights, and there are multiple counterweights with the same or different weights, so that when the user works out, different users choose the counterweights with different weights to assemble with the first grip rod and then exercise.

However, the replacement operation of dumbbells in the prior art are complex, which involves firstly removing the back fasteners, dismounting the counterweights, then replacing to the counterweights of the desired weight, and getting the fasteners tightened. In this case, the assembly steps are complex and may easily cause difficulties in assembly or lead to injury to the user.

SUMMARY

The present disclosure provides a dumbbell for solving the problem of acquiring a simple and flexible counterweight assembly of dumbbells.

To achieve the above purpose, the present disclosure provides a dumbbell, which includes a first grip rod, each of both ends of the first grip rod defines a first screw hole; and two counterweight assemblies, each of the two counterweight assemblies includes a first counterweight, the first counterweight includes a first connection portion, the first connection portion is threadedly received in the first screw hole to connect the first grip rod with the first counterweight.

In at least one embodiment, each of the two counterweight assemblies further includes a second counterweight, the second counterweight includes a second connection portion, a second screw hole is defined in the first counterweight, the second connection portion is threadedly received in the second screw hole.

In at least one embodiment, no screw hole is defined in an opposite surface of the second counterweight away from the first grip rod.

In at least one embodiment, the opposite surface of the second counterweight away from the first grip rod is flat.

In at least one embodiment, a quantity of the at least one first counterweight is more than one, each of the at least one first counterweight defines a second screw hole, two adjacent first counterweights are connected by screwing the first connection portion into respective second screw hole.

In at least one embodiment, the dumbbell further includes at least two protecting elements, each protecting element is sleeved on respective first counterweight adjacent to the first grip rod; and/or each protecting element is sleeved on respective first counterweight farthest from the first grip rod.

In at least one embodiment, the protecting element includes a protecting portion, sleeved on a first periphery surface of the first counterweight; and a clamping portion, connected with the protecting portion at an angle, the clamping portion is attached on a first side surface or a second side surface of the first counterweight, the first side surface is opposite to the second side surface.

In at least one embodiment, the dumbbell further includes at least two protecting elements, each protecting element is sleeved on respective first counterweight adjacent to the first grip rod; and/or each protecting element is sleeved on respective second counterweight.

In at least one embodiment, the protecting element includes a protecting portion, sleeved on a first periphery surface of the first counterweight or sleeved on a second periphery surface of the second counterweight; and a clamping portion, connected with the protecting portion at an angle, the clamping portion is attached on a first side surface of the first counterweight or attached on a third side surface of the second counterweight.

In at least one embodiment, the dumbbell further includes at least one first washer, and the first washer is sleeved on the first connection portion of the first counterweight.

In at least one embodiment, the dumbbell further includes at least one first washer, and the first washer is sleeved on the second connection portion of the second counterweight.

In at least one embodiment, the dumbbell further includes at least one second washer, and the second washer is sleeved on the first counterweight.

In at least one embodiment, the dumbbell further includes at least one second washer, and the second washer is sleeved on the second counterweight.

In at least one embodiment, the first counterweight includes a chamfer, the second counterweight also includes a chamfer, after the first counterweight is connected with the second counterweight, the two chamfers of the first counterweight and the second counterweight cooperatively form a groove, the dumbbell further includes a third washer, the third washer is received in the groove.

In at least one embodiment, a surface of the first grip rod is provided with at least one anti-slip groove.

In at least one embodiment, the first counterweight has a weight of 0.25~1.25 Kg; and/or the first counterweight has a diameter of 63~118 mm.

In at least one embodiment, the dumbbell further includes a sleeve, the sleeve is sleeved on the first grip rod, and the sleeve is made of foam, rubber, or flexible plastic.

In at least one embodiment, the sleeve in a natural state has a thickness of 3.5~4.5 mm, and the sleeve in a compressed state has a thickness of 2~3 mm.

The present disclosure also provides a fitness equipment, which includes a second grip rod and at least two dumbbells, a length of the second grip rod is greater than a length of the first grip rod, and the at least two dumbbells are threadedly connected with two opposite ends of the second grip rod.

In at least one embodiment, the second grip rod is integrally formed; or, the second grip rod is assembled in a detachable manner.

The present disclosure involves beneficial effects that: the first counterweights are connected to the first grip rod through screwing the first connection portions into the first screw holes, the thread structure has a firm connection, thus avoiding the first counterweights getting loosen or shaking, and guaranteeing a high usage safety. Further, the first counterweight can be separated from the first grip rod by unscrewing the first connection portion from the first screw hole, the assembly operation and the disassembly operation are simple and flexible. Therefore, the dumbbell of the present disclosure has the advantages of safety, simple, and flexible.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION

Figure 1:
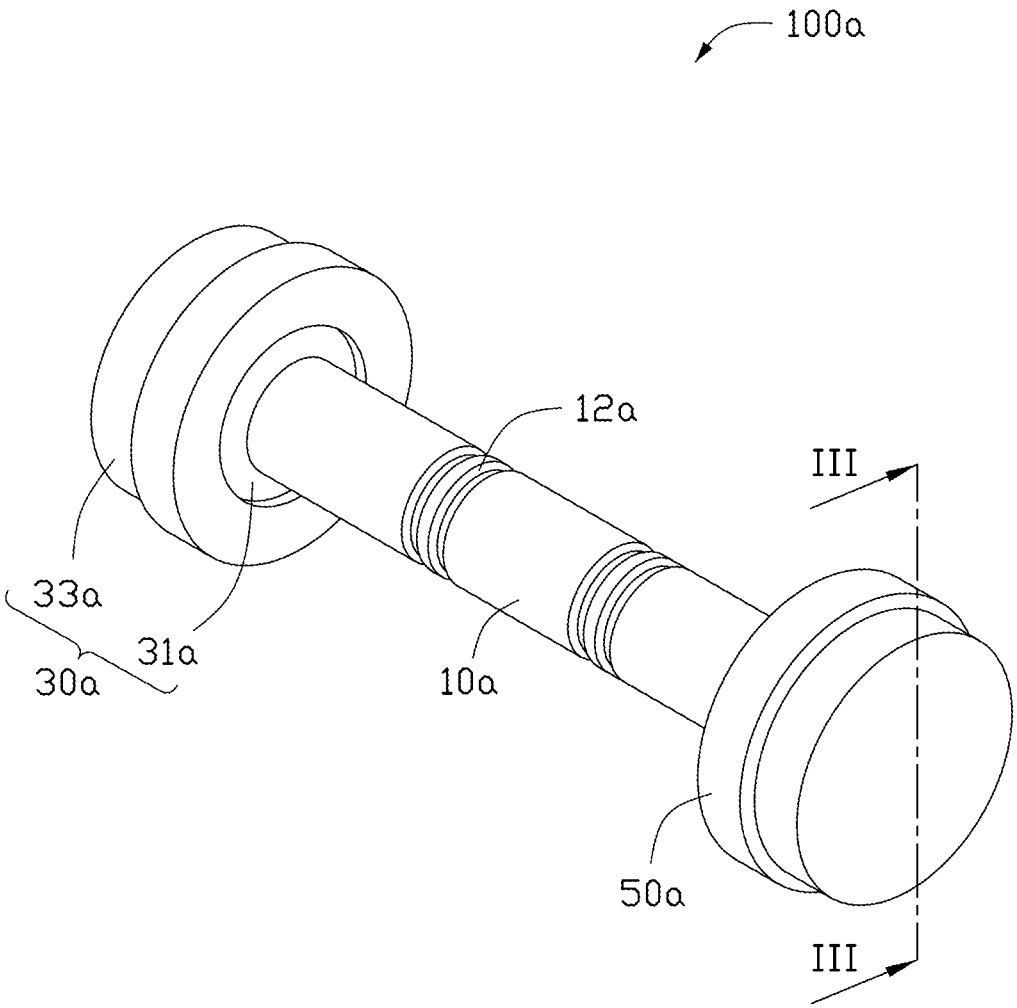
FIG. 1 is a schematic structure diagram of a dumbbell according to a first embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The present disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Figure 2:
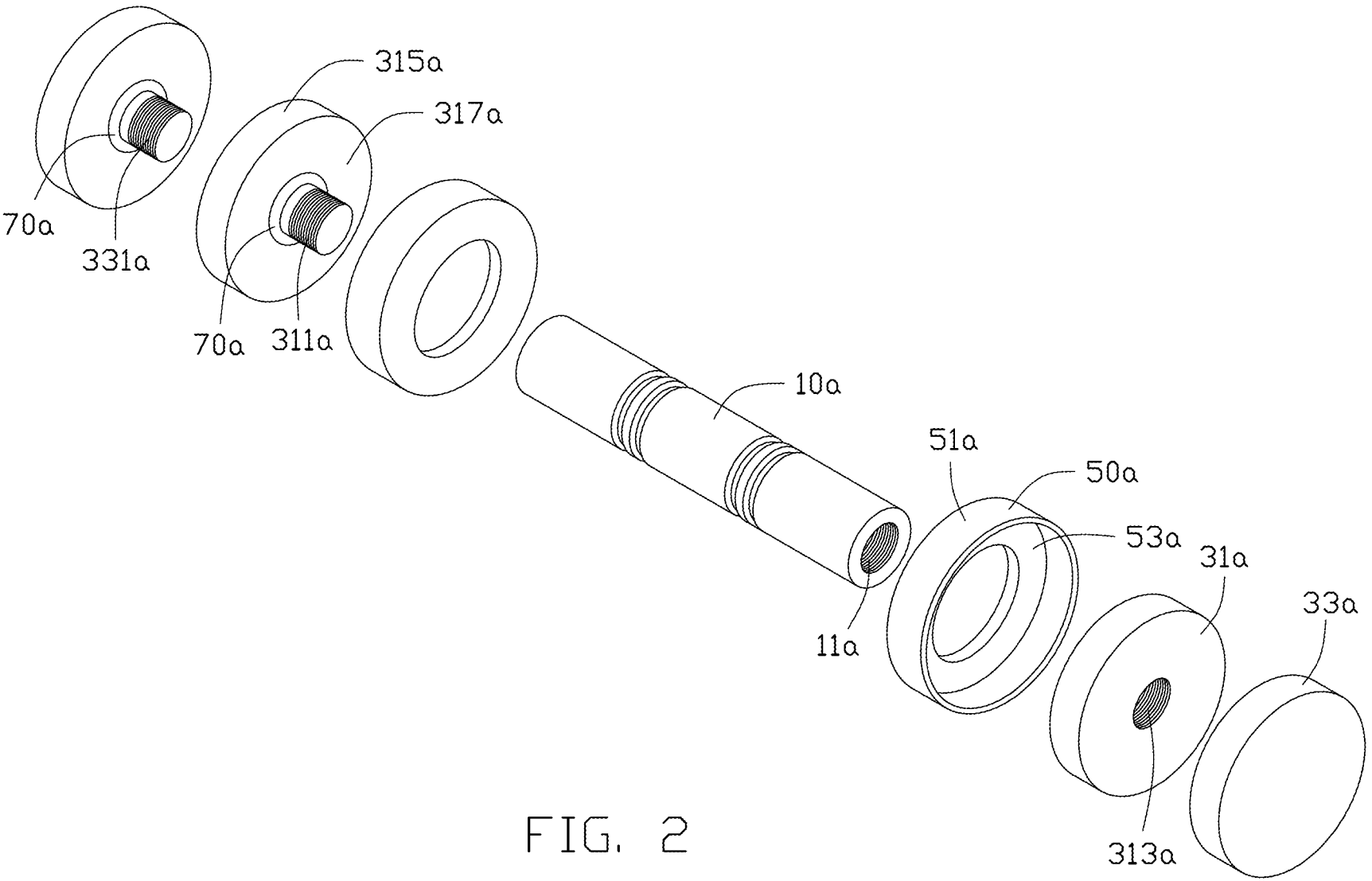
FIG. 2 is an exploded diagram of the dumbbell of FIG. 1.
Figure 3:
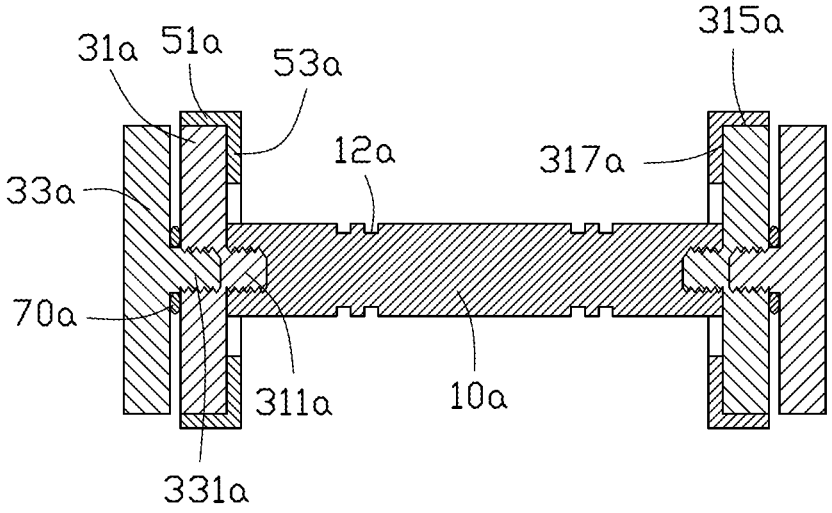
FIG. 3 is a cross sectional view of the dumbbell of FIG. 1 along a line

Referring to FIGS. 1 to 3, in the first embodiment of the present disclosure, the dumbbell 100*a* includes a first grip rod 10*a* and two counterweight assemblies 30*a* symmetrically connected to both ends of the first grip rod 10*a*. Each of both ends of the first grip rod 10*a* defines a first screw hole 11*a*, each counterweight assembly 30*a* includes at least one first counterweight 31*a*, the first counterweight 31*a* includes a first connection portion 311*a*, the first connection portion 311*a* is are threadedly received in the first screw holes 11*a* to connect the first grip rod 10*a* with the first counterweight 31*a*. The first counterweights 31*a* are connected to the first grip rod 10*a* through screwing the first connection portions 311*a* into the first screw holes 11*a*, the thread structure has a firm connection, thus avoiding the first counterweights 31*a* getting loosen or shaking, and guaranteeing a high usage safety. Further, the first counterweight 31*a* can be separated from the first grip rod 110*a* by unscrewing the first counterweight 31*a* from the first screw hole 1*a*, the assembly operation and the disassembly operation are simple and flexible. Therefore, the dumbbell 100*a* of the present disclosure has the advantages of safety, simple, and flexible.

In at least one embodiment, the first connection portion 311*a* includes an outer thread.

In at least one embodiment, the first connection portion 311*a* is arranged on a side of the first counterweight 31*a* adjacent to the first grip rod 10*a*.

In at lease one embodiment, the first connection portion 311*a* is integrated with the first counterweight 31*a*.

In another embodiment, the first connection portion 311*a* and the first counterweight 31*a* are formed separately, and then connected together.

In at least one embodiment, the first grip rod 10*a* is cylindrical.

In at least one embodiment, a surface of the first grip rod 10*a* is provided with at least one anti-slip groove 12*a*, so that the flipping through hands will not easily happen when user holds the first grip rod 10*a*.

In at least one embodiment, the first screw holes 11*a* are communicated with each other, or the first screw holes 11*a* are blind holes and spaced apart from each other.

In at least one embodiment, a quantity of the at least one first counterweight 31*a* is more than one, each of the at least one first counterweight 31*a* defines a second screw hole 313*a*, two adjacent first counterweights 31*a* are connected by screwing the first connection portion 311*a* into respective second screw hole 313*a*. The number of first counterweights 31*a* can be increased or decreased infinitely to form the dumbbells 100*a* in various weights combination. The first counterweights 31*a* can be combined and shared with each other to adjust the weight. In detail, user can assemble at least one first counterweights 31*a* with the first grip rod 10*a*, or disassemble at last one first counterweights 31*a* from the first grip rod 10*a*, as the assembly operation and the disassembly operation are simple and flexible.

In at least one embodiment, the second screw hole 313*a* is formed at a side of the first counterweight 31*a* away from the first grip rod 10*a*.

The weight of the dumbbell is generally 2.5 Kg, 5 Kg, 7.5 Kg, 10 Kg, 15 Kg, or 25 Kg. In existing art, each counterweight assembly of the dumbbell includes a connecting counterweight connected with the grip rod, at least one middle counterweight connected with the connecting counterweight, and a lateral counterweight connected with the middle counterweight, the connecting counterweight has a diameter of 63~148 mm and a weight of 0.5~5.75 Kg, the middle counterweight has a diameter of 63~148 mm and a weight of 0.25~4 Kg, the lateral counterweight has a diameter of 63~148 mm, and a weight of 0.25~2.5 Kg, users can assemble the dumbbell with desired weight. The weight of the grip rod may be 0.5 Kg, and the weight of the grip rod can be adjusted according to actual needs. Please referring to table 1, which shows the diameters and weights of the connecting counterweight, the middle counterweight, and the lateral counterweight of the existing dumbbell.

TABLE 1

Diameters and weights of the connecting counterweight, the middle counterweight, and the lateral counterweight of the existing dumbbell

| connecting counterweight | | middle counterweight | | lateral counterweight | |
|---|---|---|---|---|---|
| diameter/ mm | weight/ Kg | diameter/ mm | weight/ Kg | diameter/ mm | weight/ Kg |
| 63 | 0.5 | 63 | 0.25 | 63 | 0.25 |
| 83 | 1 | 83 | 0.75 | 83 | 0.5 |
| 93 | 1.5 | 93 | 1.25 | 93 | 0.75 |
| 98 | 2.25 | 98 | 1.5 | 98 | 1 |
| 118 | 3.25 | 118 | 2.5 | 118 | 1.5 |
| 148 | 5.75 | 148 | 4 | 148 | 2.5 |

It should be understood that, the weight of the existing dumbbell can be adjusted according to actual needs. For the existing dumbbell with a maximum weight of 2.5 Kg, its weight can be adjusted to 1 Kg, 1.5 Kg, or 2.5 Kg. For the existing dumbbell with a maximum weight of 5 Kg, its weight can be adjusted to 2.5 Kg, 3.5 Kg, 4 Kg, or 5 Kg. For the existing dumbbell with a maximum weight of 7.5 Kg, its weight can be adjusted to 3.5 Kg, 5 Kg, 6 Kg, or 7.5 Kg. For the existing dumbbell with a maximum weight of 10 Kg, its weight can be adjusted to 5 Kg, 7 Kg, 8 Kg, or 10 Kg. For the existing dumbbell with a maximum weight of 15 Kg, its weight can be adjusted to 7 Kg, 10 Kg, 12 Kg, or 15 Kg. For the existing dumbbell with a maximum weight of 25 Kg, its weight can be adjusted to 12 Kg, 17 Kg, 20 Kg, or 25 Kg. Obviously, the existing dumbbell can be adjusted to have four different weights at most.

In the present disclosure, the first counterweight has a diameter of 63~118 mm and a weight of 0.25~1.25 Kg, the second counterweight has a diameter of 63~118 mm and a weight of 0.25~1 Kg, users can assemble dumbbell with desired weight. The first grip rod 10*a* has a weight of 0.5 Kg, and the weight of the first grip rod 10*a* can be adjusted according to actual needs. Please referring to table 2, which shows the diameters and weights of the first connecting counterweight and the second counterweight of the dumbbell of the present disclosure.

TABLE 2

Diameters and weights of the first counterweight and the second counterweight of the dumbbell of the present disclosure

| first counterweight | | second counterweight | |
|---|---|---|---|
| diameter/ mm | weight/ Kg | diameter/ mm | weight/ Kg |
| 63 | 0.25 | 63 | 0.25 |
| 98 | 0.75 | 98 | 0.75 |
| 118 | 1.25 | 118 | 1 |
| 118 | 1.25 | 118 | 1 |
| 118 | 1.25 | 118 | 1 |
| 118 | 1.25 | 118 | 1 |

The weight and diameter of the first counterweight 31*a* are moderate, user can assemble several first counterweights 31*a* on the first grip rod 10*a* simultaneously, can also disassemble several first counterweights 31*a* from the first grip rod 10*a* simultaneously. User can assemble several first counterweights 31*a* on another one first counterweight 31*a*, can also disassemble several first counterweights 31*a* from another one first counterweight 31*a*. The assembly operation and the disassembly operation are simple and flexible.

In detail, in existing art, manufacturer needs to produce eighteen types of counterweights. In the present disclosure, manufacturer only needs to produce six types of counterweights need to be produced. Obviously, the dumbbell 100*a* of the present disclosure has the advantages of simple, economic, and time saving.

It should be understood that, the weight of the dumbbell 100*a* of the present disclosure can be adjusted according to actual needs. For the dumbbell 100*a* of the present disclosure with a maximum weight of 2.5 Kg, its weight can be adjusted to 1 Kg, 1.5 Kg, 2 Kg, or 2.5 Kg. For the dumbbell 100*a* of the present disclosure with a maximum weight of 5 Kg, its weight can be adjusted to 2 Kg, 3.5 Kg, or 5 Kg. For the dumbbell 100*a* of the present disclosure with a maximum weight of 7.5 Kg, its weight can be adjusted to 2.5 Kg, 3 Kg, 5 Kg, 5.5 Kg, or 7.5 Kg. For the dumbbell 100*a* of the present disclosure with a maximum weight of 10 Kg, its weight can be adjusted to 2.5 Kg, 3 Kg, 5 Kg, 5.5 Kg, 7.5 Kg, or 10 Kg. For the dumbbell 100*a* of the present disclosure with a maximum weight of 15 Kg, its weight can be adjusted to 2.5 Kg, 3 Kg, 5 Kg, 5.5 Kg, 7.5 Kg, 10 Kg, 10.5 Kg, 12.5 Kg, 13 Kg, or 15 Kg. Obviously, the dumbbell 100*a* of the present disclosure can be adjusted to have ten different weights. The dumbbell 100*a* of the present disclosure can be adjusted to have more different weights.

In at least one embodiment, each counterweight assembly 30*a* further includes a second counterweight 33*a*, each second counterweight 33*a* includes a second connection portion 331*a*, each second counterweight 33*a* is connected with respective first counterweight 31*a* by screwing the second connection portion 331*a* into respective second screw hole 313*a*. The second counterweight 33*a* can be screwed with the first counterweight 31*a* and unscrewed from the first counterweight 31*a*, the assembly operation and the disassembly operation of the second counterweight 33*a* are simple and flexible.

In at least one embodiment, the second connection portion 331*a* includes an outer thread.

In at least one embodiment, no screw hole is defined in an opposite surface of the second counterweight 33*a* away from the first grip rod 10*a*.

In at least one embodiment, the opposite surface of the second counterweight 33*a* away from the first grip rod 10*a* is flat.

In this embodiment, the first counterweight 31*a* and the second counterweight 33*a* are circular in shape. In other embodiments, the first counterweight 31*a* and the second counterweight 33*a* may be shaped as polygons such as hexagons to facilitate assembly operations.

In at least one embodiment, a diameter of the second counterweight 33*a* is substantially equal to that of the first counterweight 31*a*, and a thickness of the second counterweight 33*a* is substantially equal to that of the first counterweight 31*a*. So that, the assembly operation and the disassembly operation of the first counterweight 31*a* may not be affected by the second counterweight 33*a*.

In order to facilitate assembly, the first connection portions 311*a*, the second connection portions 331*a*, the first screw holes 11*a*, and the second screw holes 313*a* have the same thread structure size.

In at least one embodiment, the dumbbell 100*a* further includes at least two protecting elements 50*a*, the protecting elements 50*a* are sleeved on the first counterweights 31*a* adjacent to the first grip rod 10*a*. Preferably, each the protecting element 50*a* is sleeved on respective first counterweight 31*a* closest to the first grip rod 10*a*.

It can be seen that the protecting elements 50*a* will contact the ground before the first counterweights 31*a* and the second counterweight 33*a*, the protecting elements 50*a* can achieve the effect of isolating the dumbbell 100*a* from the ground, reducing the wear of the first counterweights 31*a* and the second counterweight 33*a*, and as well as avoiding the wear to the ground. The structure of the dumbbell 100*a* is simple and practical.

In order to increase the friction of the protecting element 60, an outer side of the protecting element 60 is provided with a non-slip structure, such as a pattern, knurling, bump structure, etc.

In at least one embodiment, each protecting elements 50*a* is sleeved on respective first counterweight 31*a* farthest from the first grip rod 10*a*.

In at least one embodiment, the protecting element 50*a* includes a protecting portion 51*a*, sleeved on a first periphery surface 315*a* of the first counterweight 31*a*, and a clamping portion 53*a* connected with the protecting portion 51*a* at an angle, the clamping portion 53*a* is attached on a first side surface 317*a* of the first counterweight 3*a*.

In at least one embodiment, the angle between the protecting portion 51*a* and the clamping portion 53*a* has a range of 70~110°, preferably 90°.

In at least one embodiment, a width of the protecting portion 51*a* is substantially equal to that of the first counterweight 31*a*, so as to completely isolating the dumbbell 100*a* from the ground.

In at least one embodiment, the protecting element 50*a* is made of rubber, foam, flexible plastic, silicone, or the like.

In at least one embodiment, the dumbbell 100*a* further includes at least one first washer 70*a*, and the at least one first washer 70*a* is sleeved on the first connection portion 311*a* and/or the second connection portion 331*a*. The at least one first washer 70*a* is clamped between the first counterweight 31*a* and the second counterweight 33*a*, and/or between the first counterweights 31*a*, so as to prevent the user from screwing the threads that hard to cause jamming problem.

In at least one embodiment, the first washer 70*a* is made of rubber, foam, flexible plastic, silicone, or the like.

Figure 4:
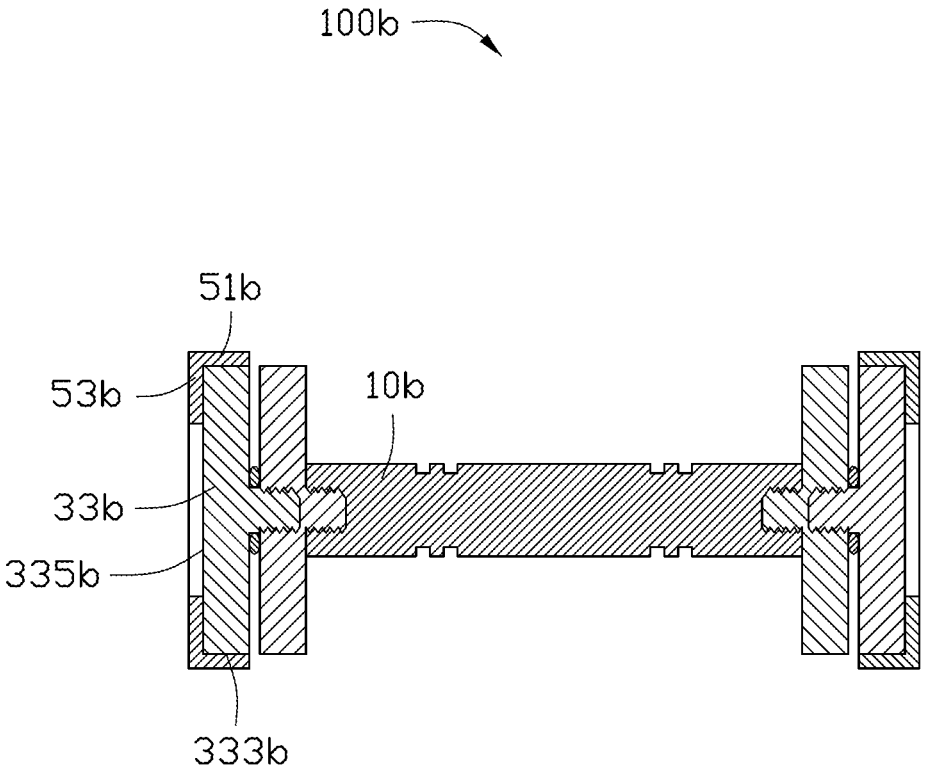
FIG. 4 is a schematic structure diagram of a dumbbell according to a second embodiment of the present disclosure.

Referring to FIG. 4, the present disclosure provides a dumbbell 100*b* according to a second embodiment. The dumbbell 100*b* is similar to the dumbbell 100*a* in structure. The difference between the dumbbell 100*b* and dumbbell 100*a* includes: the protecting elements 50*b* are sleeved on the second counterweights 33*b*.

In at least one embodiment, the protecting portion 51*b* is sleeved on the second periphery surface 333*b* of the second counterweight 33*b*, and the clamping portion 53*b* is attached on the third side surface 335*b* of the second counterweight 33*b*. No matter the dumbbell 100*b* is placed horizontally or vertically, the protecting elements 50*b* can achieve the effect of isolating the dumbbell 100*b* from the ground.

In at least one embodiment, the third side surface 335*b* of the second counterweight 33*b* is farthest from the first grip rod 10*b*.

Figure 5:
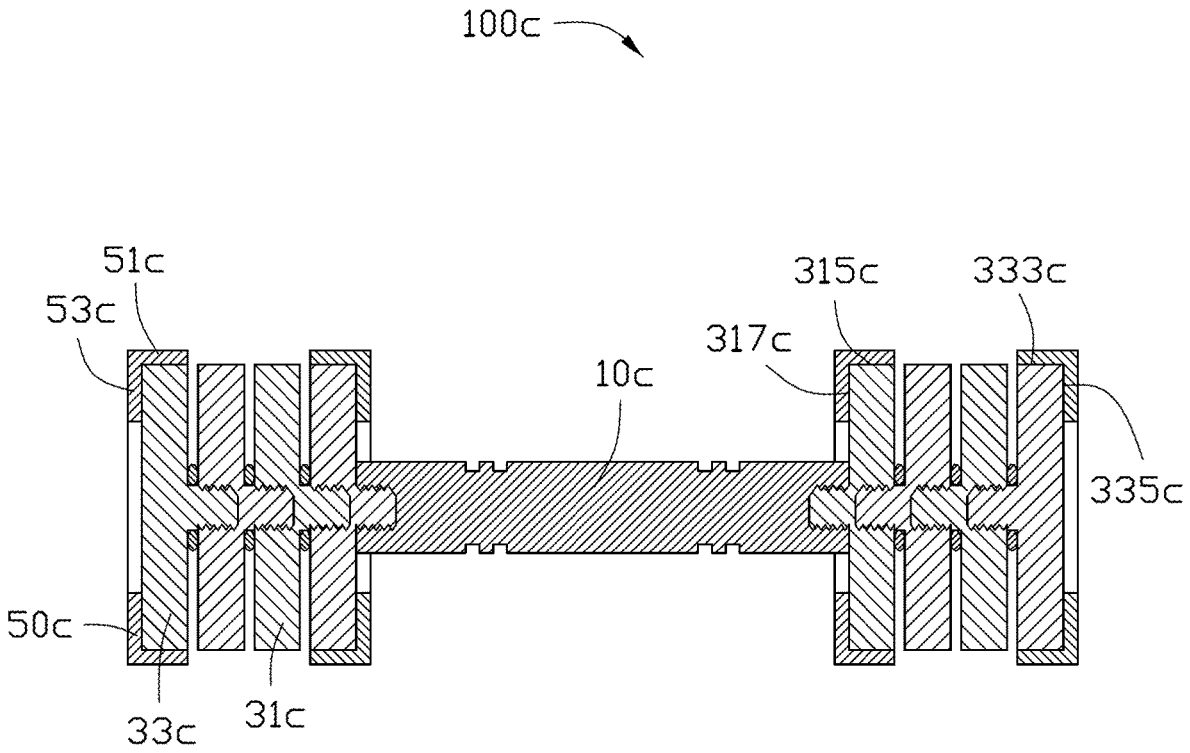
FIG. 5 is a schematic structure diagram of a dumbbell according to a third embodiment of the present disclosure.

Referring to FIG. 5, the present disclosure provides a dumbbell 100*c* according to a third embodiment. The dumbbell 100*c* is similar to the dumbbell 100*a* in structure. The difference between the dumbbell 100*c* and dumbbell 100*a* includes: the second counterweights 33*c* and the first counterweights 31*c* closest to the first grip rod 10*c* are sleeved with the protecting elements 50*c*.

In at least one embodiment, the protecting portion 51*c* is sleeved on the first periphery surface 315*c* of the first counterweight 31*c*, and the clamping portion 53*c* is attached on the first side surface 317*c* of the first counterweight 31*c*.

In at least one embodiment, the protecting portion 51*c* is sleeved on the second periphery surface 333*c* of the second counterweight 33*c*, and the clamping portion 53*c* is attached on the third side surface 335*c* of the second counterweight 33*c*.

Figure 6:
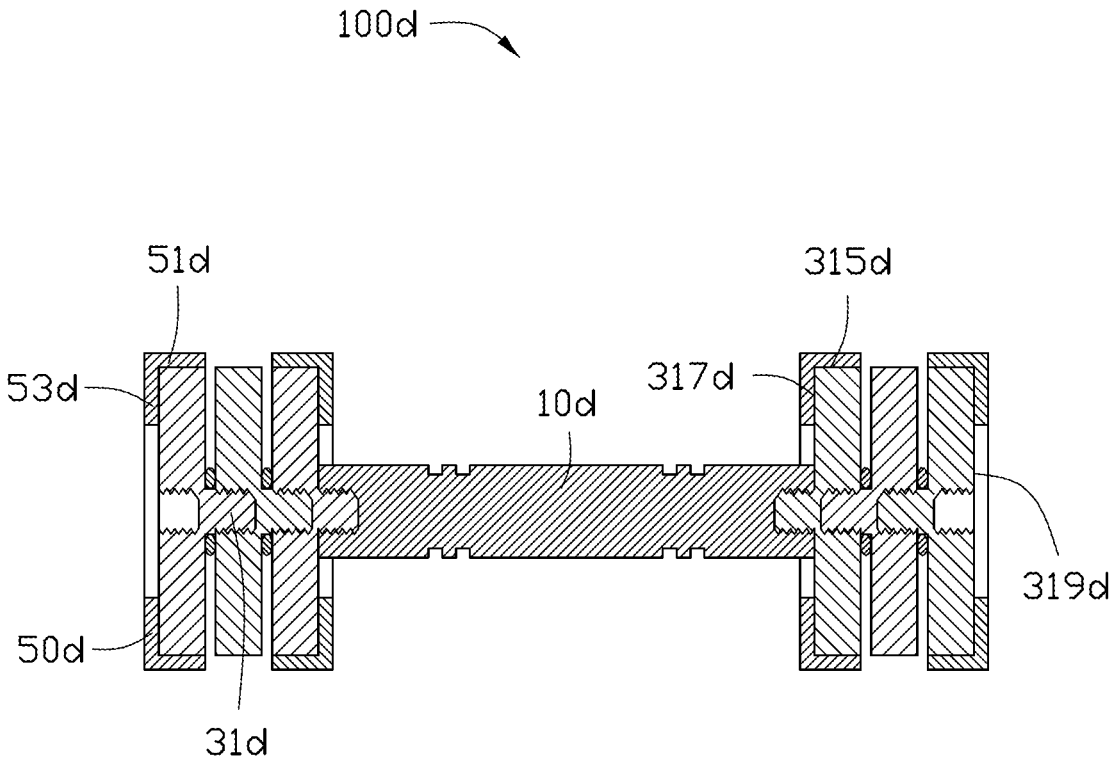
FIG. 6 is a schematic structure diagram of a dumbbell according to a fourth embodiment of the present disclosure.

Referring to FIG. 6, the present disclosure provides a dumbbell 100*d* according to a fourth embodiment. The dumbbell 100*d* is similar to the dumbbell 100*c* in structure. The difference between the dumbbell 100*d* and dumbbell 100*c* includes: the dumbbell 100*d* does not include the second counterweights, and the first counterweights 31*d* are threadedly connected with the first grip rod 10*d*.

In at least one embodiment, two first counterweights 31*d* are respectively connected with two ends of the first grip rod 10*d*, respectively. Two protecting elements 50*d* are sleeved on the two first counterweights 31*d*, respectively.

In at least one embodiment, each end of the first grip rod 10*d* are connected with at least two first counterweights 31*d*, and the first counterweights 31*d* closest to the first grip rod 10*d* and the first counterweights 31*d* farthest to the first grip rod 10*d* are sleeved with the protecting elements 50*d*.

In at least one embodiment, the protecting portion 51*d* is sleeved on the first periphery surface 315*d* of the first counterweight 31*d*, and the clamping portion 53*d* is attached on the first side surface 317*d* of the first counterweight 31*d*.

In at least one embodiment, the protecting portion 51*d* is sleeved on the first periphery surface 315*d* of the first counterweight 31*d*, and the clamping portion 53*d* is attached on the second side surface 319*d* of the first counterweights 31*d*. The first side surface 317*d* is opposite to the second side surface 319*d*.

Figure 7:
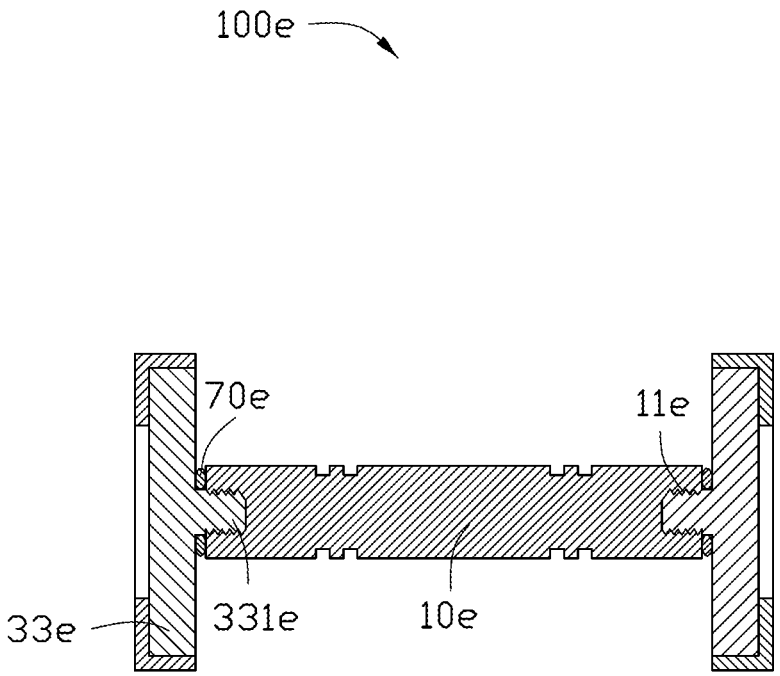
FIG. 7 is a schematic structure diagram of a dumbbell according to a fifth embodiment of the present disclosure.

Referring to FIG. 7, the present disclosure provides a dumbbell 100*e* according to a fifth embodiment. The dumbbell 100*e* is similar to the dumbbell 100*b* in structure. The difference between the dumbbell 100*e* and dumbbell 100*b* includes: the dumbbell 100*e* does not include the first counterweights, the second counterweights 33*e* are threadedly connected with the first grip rod 10*e*.

In at least one embodiment, the second connection portions 331*e* are threadedly received in the first screw holes 11*e*.

In at least one embodiment, the weight of the dumbbell 100*e* of the present disclosure can be adjusted to a minimum of 1 kg.

In at least one embodiment, the first washer 70*e* can be arranged between the first grip rod 10*e* and the second counterweight 33*e*. In detail, the first washer 70*e* is sleeved around the second connection portion 331*e*, and clamped between the second counterweight 33*e* and the first grip rod 10*e*.

Figure 8:
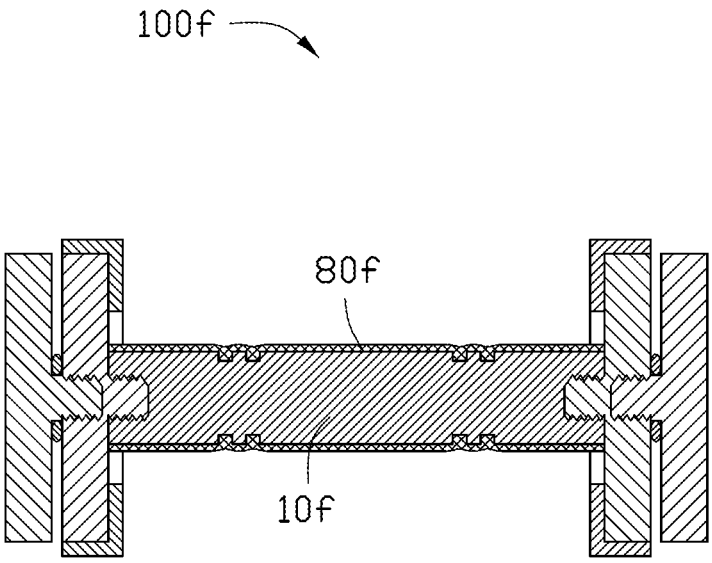
FIG. 8 is a schematic structure diagram of a dumbbell according to a sixth embodiment of the present disclosure.

Referring to FIG. 8, the present disclosure provides a dumbbell 100*f* according to a sixth embodiment. The dumbbell 100*f* is similar to the dumbbell 100*a* in structure. The difference between the dumbbell 100*f* and dumbbell 100*a* includes: the dumbbell 100*f* further includes a sleeve 80*f* sleeved on the first grip rod 10*f*.

In at least one embodiment, the sleeve 80*f* is made of foam, rubber, or flexible plastic.

In at least one embodiment, the sleeve 80*f* in a natural state has a thickness of 3.5~4.5 mm, and the sleeve 80*f* in a compressed state has a thickness of 2~3 mm, in this case, the sleeve 80*f* can provide user a good sense of grip, and users can easily keep their body weight. In detail, the thickness of a compressed portion of the sleeve 80*f* is 2~3 mm.

Figure 9:
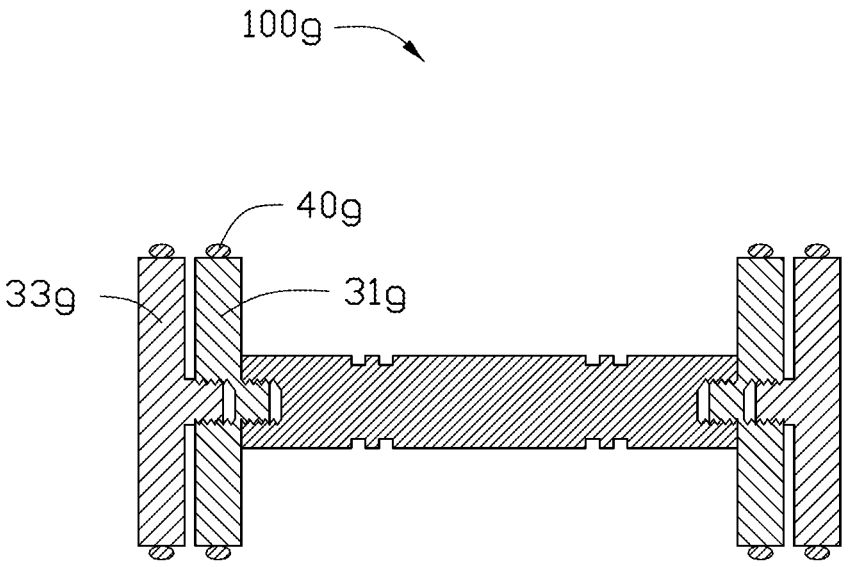
FIG. 9 is a schematic structure diagram of a dumbbell according to a seventh embodiment of the present disclosure.

Referring to FIG. 9, the present disclosure provides a dumbbell 100*g* according to a seventh embodiment. The dumbbell 100*g* is similar to the dumbbell 100*a* in structure. The difference between the dumbbell 100*g* and dumbbell 100*a* includes: the dumbbell 100*g* does not include the protecting element, and the dumbbell 100*g* further includes a second washer 40*g*, and the second washer 40*g* is sleeved on the first counterweight 31*g* and/or sleeved on the second counterweight 33*g*.

In at least one embodiment, the second washer 40*g* is ring-shaped.

In at least one embodiment, an outer surface of the second washer 40*g* is protruded from the first counterweight 31*g* and the second counterweight 33*g*. It can be seen that the third washer 40*g* will contact the ground before the first counterweights 31*g* and the second counterweight 33*g*, and can achieve the effect of isolating the dumbbell 100*g* from the ground.

Figure 10:
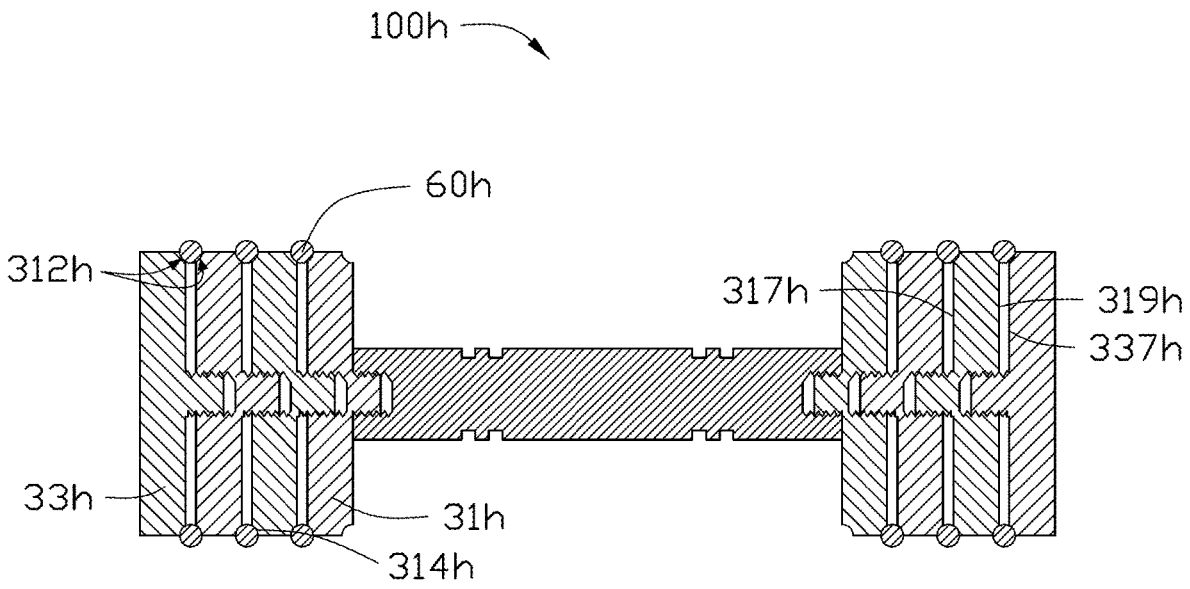
FIG. 10 is a schematic structure diagram of a dumbbell according to an eight embodiment of the present disclosure.

Referring to FIG. 10, the present disclosure provides a dumbbell 100*h* according to an eight embodiment. The dumbbell 100*h* is similar to the dumbbell 100*c* in structure. The differences between the dumbbell 100*h* and dumbbell 100*c* include: the dumbbell 100*h* does not include the protecting element, the first counterweight 31*h* includes a chamfer 312*h*, the second counterweight 31*h* also includes a chamfer 312*h*, after the first counterweight 31*h* is connected with the second counterweight 31*h*, the two chamfers 312 of the first counterweight 31*h* and the second counterweight 31*h* cooperatively form a groove 314*h*, the dumbbell 100*h* further includes a third washer 60*h*, the third washer 60*h* is received in the groove 314*h*.

In at least one embodiment, a second side surface 319*h* of the first counterweight 31*h* includes defines the chamfer 312*h*, a fourth side surface 337*h* of the second counterweight 33*h* also defines the a chamfer 312*h*, the fourth side surface 337*h* of the second counterweight 33*h* is adjacent to the second side surface 319*h* of the first counterweight 31*h*, after the first counterweight 31*h* is connected with the second counterweight 33*h*, the chamfers 312*h* cooperatively form the groove 314*h*.

In at least one embodiment, the third washer 60*h* is ring-shaped.

In at least one embodiment, an outer surface of the third washer 60*h* is protruded from the first counterweight 31*h* and the second counterweight 33*h*.

In at least one embodiment, the second side surface 319*h* of the first counterweight 31*h* includes a chamfer 312*h*, and the first side surface 315*h* of the first counterweight 31*h* includes a chamfer 312*h*, after the two adjacent first counterweights 31*h* are connected together, the two chamfers 312*h* cooperatively form another groove 314*h*, the third washer 60*h* may be received in the groove 314*h*.

It can be seen that the third washer 60*h* will contact the ground before the first counterweights 31*h* and the second counterweight 33*h*, and can achieve the effect of isolating the dumbbell 100*h* from the ground.

Figure 11:
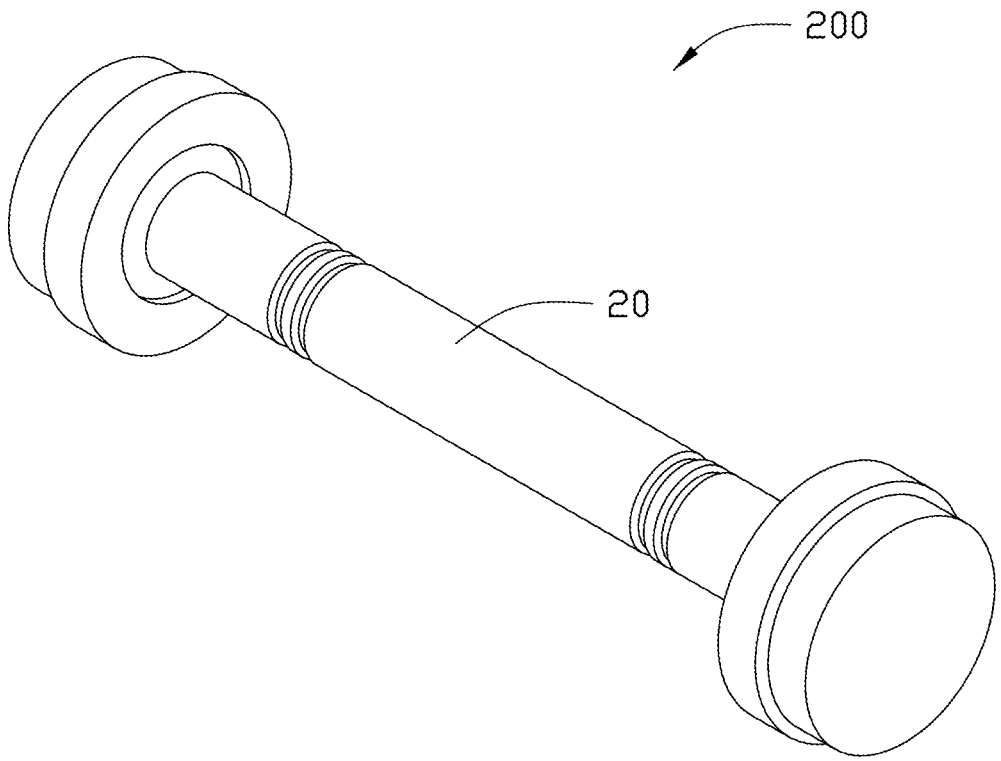
FIG. 11 is a schematic structure diagram of a fitness equipment according to a first embodiment of the present disclosure.

Referring to FIG. 11, the present disclosure provides a fitness equipment 200 according to a first embodiment. The fitness equipment 200 is similar to the dumbbell (100*a*, 100*b*, 100*c*, 100*d*, 100*e* and 100*f*) in structure. The difference between the fitness equipment 200 and dumbbell (100*a*, 100*b*, 100*c*, 100*d*, 100*e* and 100*f*) includes: a length of the second grip rod 20 is greater than that of the first grip rod 10*a*. The length of the second grip rod 20 is significantly increased, and the holding width of the user's hand can be wider, so that the fitness equipment 200 can be used as a barbell. The first grip rod (10*a*, 10*b*, 10*c*, 10*d*, 10*e* and 10*f*) of the dumbbell (100*a*, 100*b*, 100*c*, 100*d*, 100*e* and 100*f*), on the other hand, has a shorter length and a narrower holding width of the user's hand, which can be suitable for the usage of the dumbbell.

In at least one embodiment, the second grip rod 20 has an integrally formed structure, which is a cylindrical bar.

In other embodiment, the second grip rod 20 can also be a detachable assembly, for example, a snap structure, a socket structure, or a thread structure is formed on the second grip rod 20, and the second grip rod 20 is assembled by a plurality of second grip rods 20. During producing and selling, multiple second grip rods 20 are separated from each other to facilitate packaging and transportation; while when used by users, users can assemble multiple second grip rods 20 to form second grip rods 20 of different lengths according to the needed length of use.

Figure 12:
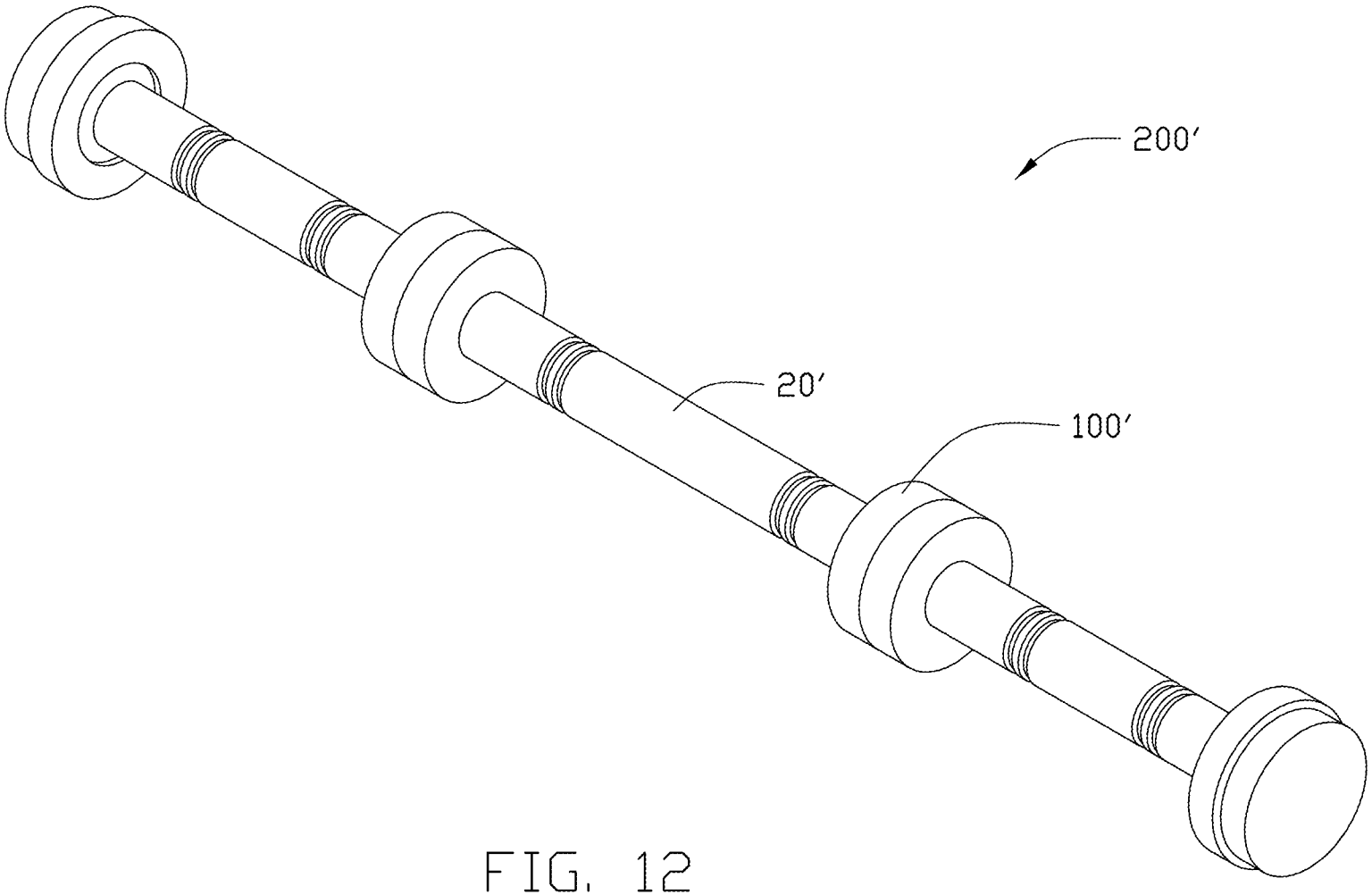
FIG. 12 is a schematic structure diagram of a fitness equipment according to a second embodiment of the present disclosure.
Figure 13:
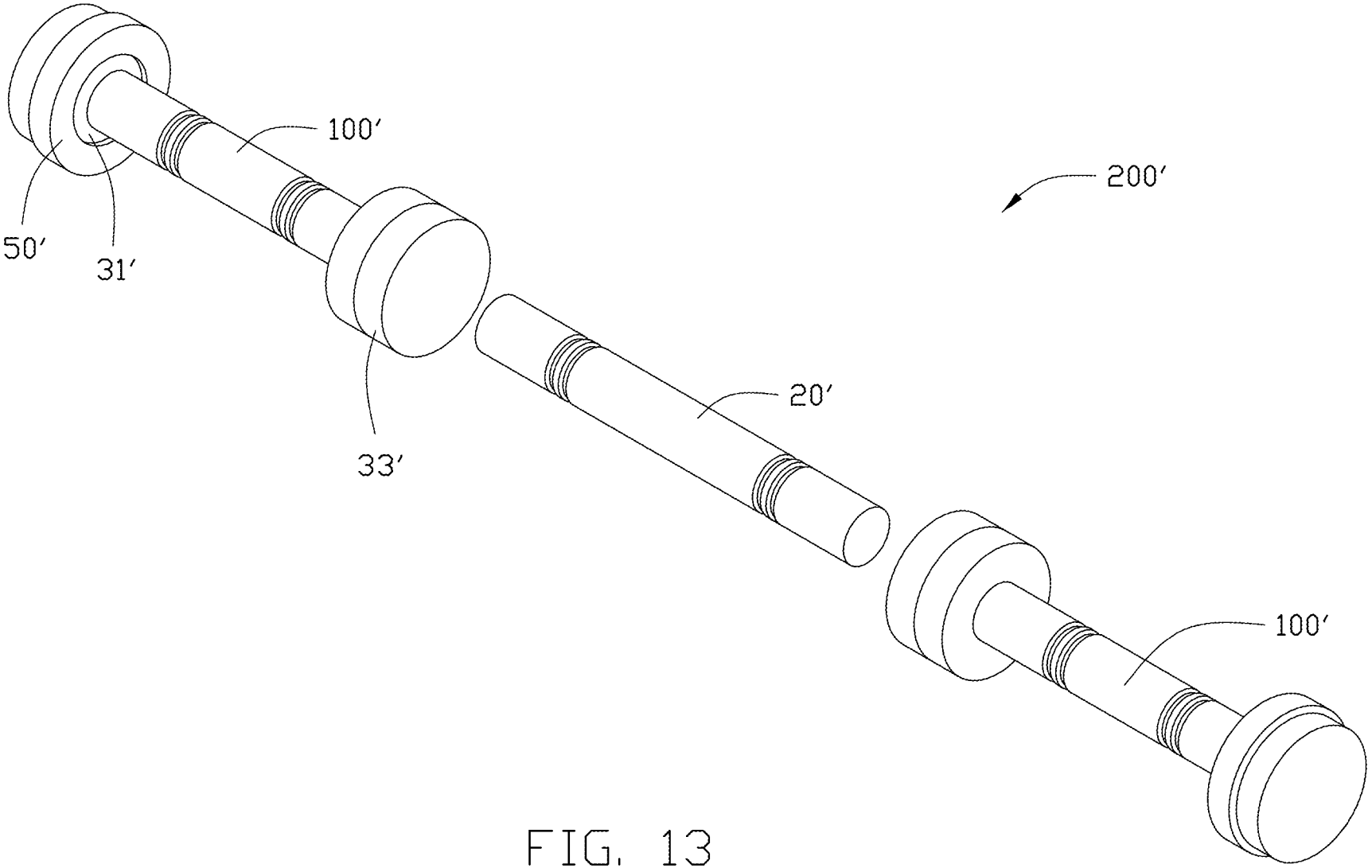
FIG. 13 is an exploded diagram of the fitness equipment of FIG. 12.

Referring to FIGS. 12 and 13, the present disclosure provides a fitness equipment 200' according to a second embodiment. The fitness equipment 200' includes a second grip rod 20', and at least two dumbbells 100' connected with both ends of the second grip rod 20' respectively.

The dumbbell 100' is similar to the dumbbell (100*a*, 100*b*, 100*c*, 100*e*, 100*f*, 100*g*, 100*h*) in structure. The difference between the fitness equipment 200' and dumbbell (100*a*, 100*b*, 100*c*, 100*e*, 100*f*, 100*g*, 100*h*) includes: a length of the second grip rod 20' is greater than that of above first grip rod; two end of the second grip rod 20' may be firmly bonded with the second counterweights 33'.

Herein, the second grip rod 20' is longer than above first grip rod, thus allowing the user to use the fitness equipment 200' as a barbell.

In at least one embodiment, the protecting elements 50' are sleeved on the first counterweights 31*a*' farthest from the second grip rod 20'. It should be understood that, the protecting elements 50' can be sleeved on other first counterweights 31' and/or the second counterweights 33'.

Figure 14:
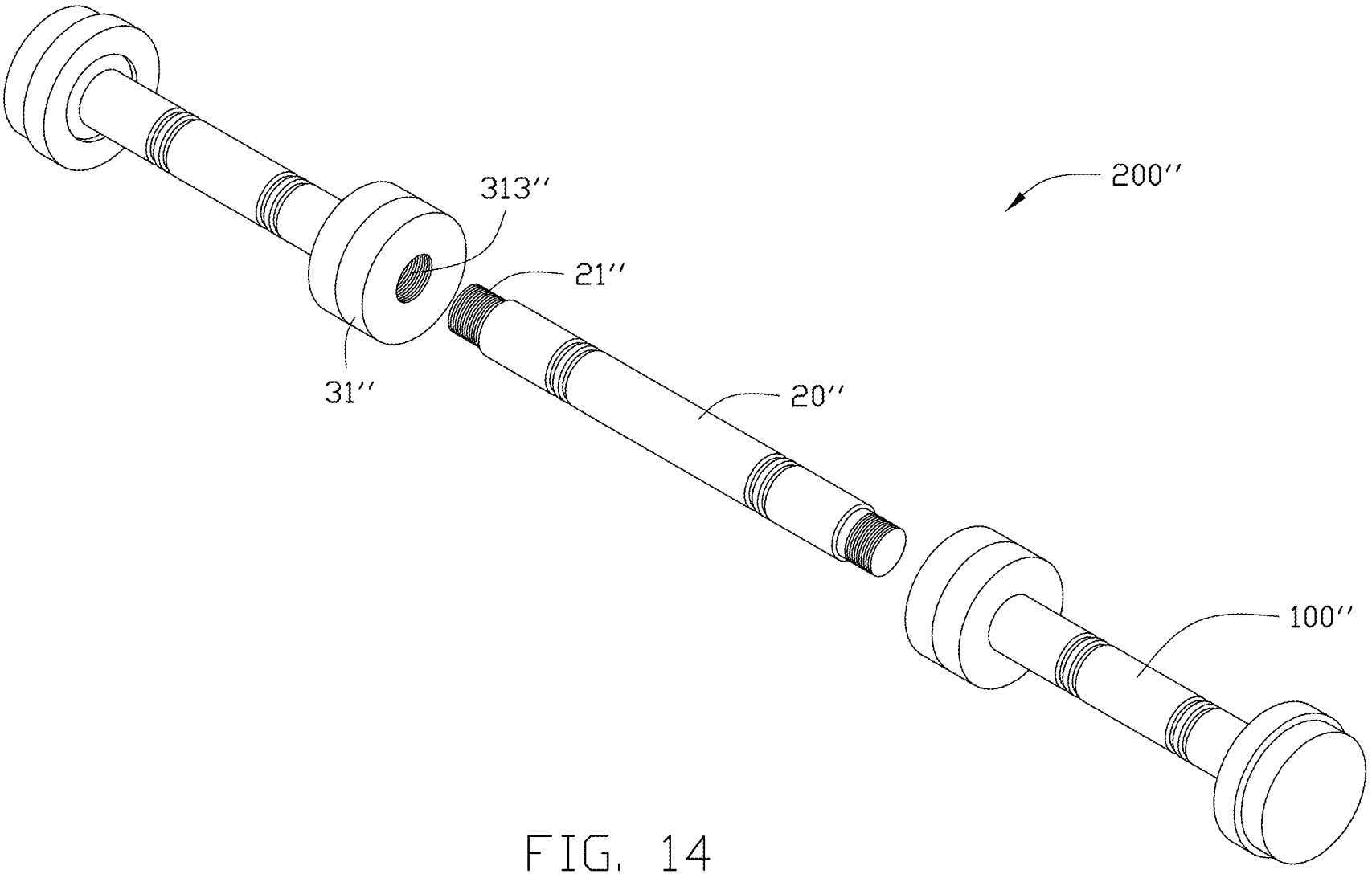
FIG. 14 is a schematic structure diagram of a fitness equipment according to a third embodiment of the present disclosure.

Referring to FIG. 14, the present disclosure provides a fitness equipment 200" according to a third embodiment. The fitness equipment 200" includes a second grip rod 20", and at least two dumbbells 100" connected with both ends of the second grip rod 20" respectively.

The difference between the fitness equipment 200" and the fitness equipment 200' includes: the dumbbell 100" is similar to the dumbbell 100*d* in structure; the second grip rod 20" includes two third connecting portions 21", the third connecting portions 21" are received in the second screw holes 313" of the first counterweights 31", to connect the second grip rod 20" with the dumbbells 100".

In at least one embodiment, the third connecting portion 21" includes an external thread.

In at least one embodiment, two ends of the second grip rod 20" are detachably connected with two dumbbells 100*d*.

The above description is merely some embodiments. It should be noted that for one with ordinary skills in the art, improvements can be made without departing from the concept of the present disclosure, but these improvements shall fall into the protection scope of the present disclosure.

What is claimed is:

1. A dumbbell, comprising:

a first grip rod, comprising a body portion and two thread connection portions respectively disposed at two ends of the body portion; each of the two thread connection portions defines a first screw hole; wherein threads are arranged on only an inner hole wall of the first screw hole; an end surface of each of the two thread connection portions away from the body portion is recessed inwardly towards the body portion to form the first screw hole having the threads on the inner hole wall; an outer circumferential surface of each of the two thread connection portions is flushed with an outer circumferential surface of the body portion of the first grip rod; and two counterweight assemblies, each of the two counterweight assemblies comprises at least one first counterweight, the at least one first counterweight comprises a first connection portion, the first connection portion is threadedly received in the respective first screw hole and connected to the threads on the inner hole wall of the respective first screw hole to connect the first grip rod with the at least one first counterweight;

wherein, each of the two counterweight assemblies further comprises a second counterweight, the second counterweight comprises a second connection portion, a second screw hole is defined in each of the at least one first counterweight, the second connection portion is threadedly received in the respective second screw hole; wherein the dumbbell further comprises at least two protecting elements, each protecting element of the at least two protecting elements is sleeved on respective first counterweight of the at least one counterweights adjacent to the first grip rod; and/or each protecting element of the at least two protecting elements is sleeved on respective first counterweight of the at least one counterweights farthest from the first grip rod.

2. The dumbbell according to claim 1, wherein no screw hole is defined in an opposite surface of each of the second counterweights away from the first grip rod.

3. The dumbbell according to claim 2, wherein each of the opposite surfaces of the second counterweights away from the first grip rod is flat.

4. The dumbbell according to claim 1, each protecting element of the at least two protecting elements is sleeved on respective first counterweight of the at least one counterweights adjacent to the first grip rod; and/or each protecting element of the at least two protecting elements is sleeved on respective second counterweight.

5. The dumbbell according to claim 4, wherein each protecting element of the at least two protecting elements comprises:

a protecting portion, sleeved on a first periphery surface of the respective first counterweight or sleeved on a second periphery surface of the second counterweight; and a clamping portion, connected with the protecting portion at an angle, the clamping portion is attached on a first side surface of the respective first counterweight or attached on a third side surface of the second counterweight.

6. The dumbbell according to claim 1, further comprising a sleeve, the sleeve is sleeved on the first grip rod, and the sleeve is made of foam, rubber, or flexible plastic.

7. The dumbbell according to claim 6, wherein the sleeve in a natural state has a thickness of 3.5~4.5 mm, and the sleeve in a compressed state has a thickness of 2~3 mm.

8. The dumbbell according to claim 1, wherein a quantity of the at least one first counterweight is more than one, each of the more than one first counterweights defines a second screw hole, two adjacent counterweights of the more than one first counterweights are connected by screwing the first connection portion into respective second screw hole.

9. The dumbbell according to claim 1, wherein each protecting element of the at least two protecting elements comprises:

a protecting portion, sleeved on a first periphery surface of the respective first counterweight; and a clamping portion, connected with the protecting portion at an angle, the clamping portion is attached on a first side surface or a second side surface of the respective first counterweight, the first side surface is opposite to the second side surface.

10. The dumbbell according to claim 1, wherein the dumbbell further comprises at least one first washer, and each of the at least one first washer is sleeved on the first connection portion of a respective one the at least one first counterweight of a respective one of the two counterweight assemblies.

11. The dumbbell according to claim 1, wherein the dumbbell further comprises at least one first washer, and each of the at least one first washer is sleeved on the second connection portion of the second counterweight of a respective one of the two counterweight assemblies.

12. The dumbbell according to claim 1, wherein the dumbbell further comprises at least one second washer, and each of the at least one second washer is sleeved on a respective one of the at least one first counterweight of a respective one of the two counterweight assemblies.

13. The dumbbell according to claim 1, wherein the dumbbell further comprises at least one second washer, and each of the at least one second washer is sleeved on the second counterweight of a respective one of the two counterweight assemblies.

14. The dumbbell according to claim 1, wherein, for each of the two counterweight assemblies, each of the at least one first counterweight comprises a chamfer, the second counterweight also comprises a chamfer, after the at least one first counterweight is connected with the second counterweight, the chamfers of a respective one of the at least one first counterweight and the second counterweight cooperatively form a groove, the dumbbell further comprises a third washer, the third washer is received in the groove.

15. The dumbbell according to claim 1, wherein a surface of the first grip rod is provided with at least one anti-slip groove.

16. The dumbbell according to claim 1, wherein the at least one first counterweight has a weight of 0.25~1.25 Kg; and/or the at least one first counterweight has a diameter of 63~118 mm.

17. A fitness equipment, comprising a second grip rod and at least two dumbbells as described in claim 1, wherein a length of the second grip rod is greater than a length of the first grip rod, and the at least two dumbbells are threadedly connected with two opposite ends of the second grip rod; wherein, the second grip rod is integrally formed; or, the second grip rod is assembled in a detachable manner.

18. The dumbbell according to claim 1, wherein, each end of the first grip rod has an end surface facing towards a respective one of the two counterweight assemblies; the end surface of each end is recessed inwardly to form the first screw hole;

for each of the two counterweight assemblies, each of the at least one first counterweight has a counterweight end surface facing towards the first grip rod, and the first connection portion is protruding from the counterweight end surface;

for each of the two counterweight assemblies, when the first connection portion is threadly received in the respective first screw hole, a portion of the respective end surface of the first grip rod that is not recessed directly or indirectly abuts against the counterweight end surface.

* * * * *